US006092771A

United States Patent [19]

Fich

[11] Patent Number: 6,092,771

[45] Date of Patent: Jul. 25, 2000

[54] LEG FOR A PIECE FURNITURE WITH A TELESCOPICALLY MOVABLE PORTION

[75] Inventor: Preben Bo Fich, Sandgate, United Kingdom

[73] Assignee: Ideassociates, LTD, Dublin, Ireland

[21] Appl. No.: 09/091,822

[22] PCT Filed: Jan. 17, 1997

[86] PCT No.: PCT/DK97/00022

§ 371 Date: Jul. 17, 1998

§ 102(e) Date: Jul. 17, 1998

[87] PCT Pub. No.: WO97/25904

PCT Pub. Date: Jul. 24, 1997

[30] Foreign Application Priority Data

Jan. 19, 1996 [DK] Denmark ..... 0052/96

[51] Int. Cl.[7] ..... F16M 11/26

[52] U.S. Cl. ..... 248/188.5; 248/407

[58] Field of Search ..... 248/188.1, 188.2, 248/188.5, 407, 649; 108/147.2, 139

[56] References Cited

U.S. PATENT DOCUMENTS

| | | | |
|---|---|---|---|
| 734,509 | 7/1903 | Ceasar | 248/188.5 |
| 2,703,691 | 3/1955 | Minnis | 248/188.5 |
| 2,719,688 | 10/1955 | Seifert | 248/191 |
| 2,933,275 | 4/1960 | Wimmersoerg | 248/188.5 |
| 3,179,071 | 4/1965 | Johnston | 108/144 |
| 3,864,048 | 2/1975 | Parker | 248/188.5 |
| 4,191,111 | 3/1980 | Emmert | 248/188.5 |
| 4,650,145 | 3/1987 | Natzel et al. | 248/188.5 |
| 5,746,152 | 5/1998 | Huse | 248/188.5 |

FOREIGN PATENT DOCUMENTS

| | | |
|---|---|---|
| 743033 | 11/1966 | European Pat. Off. . |
| 165190 | 12/1985 | European Pat. Off. . |
| 707806 | 4/1996 | European Pat. Off. . |
| 904938 | 2/1954 | Germany . |
| 3129851 | 2/1983 | Germany . |
| 379144 | 9/1975 | Sweden . |
| 442581 | 1/1986 | Sweden . |

*Primary Examiner*—Anita M. King
*Assistant Examiner*—Gwendolyn Baxter
*Attorney, Agent, or Firm*—Miles & Stockbridge; Dennis P. Clarke

[57] ABSTRACT

A furniture leg is disclosed with a telescopically movable portion for adjusting the height of the furniture wherein the leg includes an upper leg portion comprising a tube, a lower leg portion adapted to rest on the floor and the lower leg portion being inserted into and being telescopically movable with respect to the upper leg portion and having a cross-section corresponding to the clear in the upper leg portion apart from a groove extending in the longitudinal direction.

4 Claims, 5 Drawing Sheets

LEG FOR A PIECE FURNITURE WITH A TELESCOPICALLY MOVABLE PORTION

BACKGROUND OF THE INVENTION

1. Field of the Invention

Figure 1:
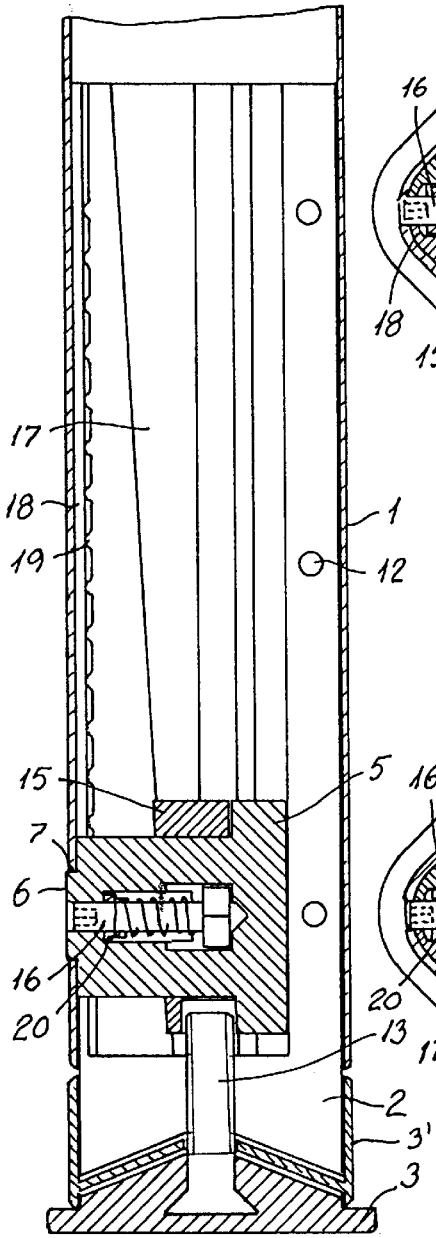

The present invention relates a leg for a piece of furniture.

2. Description of the Prior Art

Among others, describes SE B 442.581 a leg for a piece of furniture is known which for adjustment of the height of the table above the floor is provided with a telescopically movable portion which may be secured in the upper portion which is connected with the tabletop by means of a screw inserted in a threaded hole in the tube side on the upper portion of the leg. On account of the considerable impact on the lower portion from the screw, the lower portion has to be manufactured from a solid material, which makes the construction heavy. In order to make the threaded hole for the screw sufficiently strong, the tube wall around the threaded hole has to have a considerable thickness or be reinforced, for instance by a nut being welded on, which nut may subsequently be abraded for rounding of the corners, which is a laborious process making the whole construction more expensive. Where the tube wall in the upper portion has sufficient thickness for accommodating the threaded hole, the lower leg portion will have substantially smaller cross-section than the upper leg portion, which may be a drawback from an aesthetic point of view and it entails in any case a big material consumption for the upper leg portion and the whole construction becomes comparatively heavy.

Moreover, pieces of furniture are known, in which one of the legs is provided with a lower portion inserted in the upper leg portion by means of a thread, and by means of which the height of one of the legs may be adjusted in order to compensate for irregularities in the floor, or, if all the legs are provided with such a threaded portion, the height of the piece of furniture may be adjusted within a certain interval.

Moreover, a central column for a swivel chair is known, in which the parts are so to speak reversed, such that the tubular portion is placed in the base and the displaceable portion is extending upwards. The fastening device comprises a ring resting against the tubular portion and comprising a guide for the solidly designed, movable portion. The arrangement is based on the use of a screw pressing against the side of the displaceable portion and therefore suffers from the same drawbacks as the constructions discussed above.

It may be desirable in a piece of furniture to be able to change the length of all legs in order to change the height of the piece of furniture, and it will in this connection be desirable that the piece of furniture stands just as stable on the floor as before the adjustment. The adjustment is in other words to be carried out stepwise, and it should be simple to change the individual legs by the same number of steps. Moreover, there is a need for the adjustment interval to be big, for instance 25 cm, which corresponds to approx. ⅓ of the height of a leg. Furthermore, it is of importance that the adjustment may be incorporated in legs for pieces of furniture in which at least a part of the leg is manufactured from a seam-welded steel tube, and where the preparatory steps to be made to the tube are minimal and not damaging to a surface treatment previously made.

It is the object of the invention to provide a leg for a piece of furniture, which meets these requirements and in which such a stepwise adjustment may be made, such that a piece of furniture which has been levelled in advance retains its levelling after the height adjustment, and in which the leg for the piece of furniture is simple to adjust and stable in all settings.

It is also an object of the invention to design the fixing means in such a way that the leg for the piece of furniture on the outside appears with a surface without protrusions protruding substantially outside the surface of the upper leg portion.

These objects are met by a leg for a piece of furniture which is characterized by the subject matter of the characterizing clause of claim 1.

The lower leg portion is stably movable in the upper leg portion, because it substantially fills out the clear thereof, whereas the locking mechanism is placed in the longitudinal groove. Hereby, a construction is obtained, in which the difference between the cross-sections of the two portions is minimal, and in which the fixing means may be discreetly accommodated, as they do not have to protrude outside the hole in the tube wall, in which they are fastened, which is of considerable importance for the appearance of the piece of furniture.

When the adjustment of the height of the legs has taken place, it is advantageous that it is possible to obtain a locking of the height set. According to the invention a locking screw is placed in the protrusion, by means of which locking screw fixing means may be retained relative to the lower leg portion in the steps determined by the locking mechanism. In this embodiment no further changes have to be added to the upper leg portion, which thus preserves its smooth appearance.

In the simplest embodiment of the leg for the piece of furniture according to the invention the mechanism comprises a spring-loaded protrusion engaging a list provided with notches. By this embodiment the adjustment will take place stepwise, each step being marked by a click. When the desired height has been reached, the leg may be locked by additional fastening. This embodiment of the leg for the piece of furniture is well suited for legs for a piece of furniture, the cross-section of which deviates from the circular, as it is not required that the lower portion is rotatable with respect to the upper portion.

According to another embodiment of the leg for a piece of furniture according to the invention the lower leg portion can be rotated relative to the fixing means, and the longitudinal groove in its side wall has a row of recesses spaced by the same module, with which at least one protrusion on the fixing means may get into engagement and be disengaged by rotating of the lower leg portion in one direction or the other. This embodiment is advantageous in that a possible locking of the adjustment of the leg for the piece of furniture is not to transfer the load which is carried by the leg for the piece of furniture. This load is namely carried by the engagement between the protrusions and the recesses. The locking just has to prevent the two portions from being rotated relative to each other.

A special embodiment, in which the lower portion is only moved one step, each time it is rotated between one or the other of two positions, is characterized in that the longitudinal groove is provided with recesses along both sides, the fixing means having protrusions adapted to engage one or the other row of recesses, the recesses having such a distance from and such a width relative to the protrusions that the lower leg portion, when rotated to one of the sides, is movable over such a length that the disengaged protrusions may move one length corresponding to the module in the second row of recesses. In this embodiment there is no risk of the leg for the piece of furniture unintentionally sliding into its shortest position, if it is loaded during the adjustment.

In these embodiments an advantageous design of a securing against rotation, which at the same time conceals the locking means necessary for the height adjustment, may be characteristic in that the upper leg portion is surrounded by a movable cover skirt which is provided with an interior profiling which makes it substantially secured against rotation relative to the upper leg portion, said covering skirt engaging in its lowest position the lower leg portion and locking/securing it against rotation relative to the covering skirt. The covering skirt imparts a completely smooth appearance to the leg for the piece of furniture, the longitudinal groove being hidden, and at the same time an effective locking of the obtained adjustment is achieved. If the setting is to be adjusted, the skirt is lifted, whereby the lower leg portion is exposed so that it may be rotated and subsequently be adjusted as to height.

Another embodiment of the leg for a piece of furniture, and in which the circular cross-section of the upper leg portion is not a prerequisite, is characterized in that the longitudinal groove comprises a toothing along both side faces, which toothing does not extend through the whole depth of the groove, and in which a locking means, which at the side faces is provided with a corresponding toothing, is movable relative to the fixing means in a direction perpendicular to the longitudinal axis of the leg for the piece of furniture against a spring load in engagement with and in disengagement with the toothing in the longitudinal groove. By this embodiment the locking means may in one position be brought completely out of engagement with the toothing and in the other position act as an expander expanding the groove to such an extent that the lower portion, apart from not being longitudinally movable via the locking means relative to the upper leg portion, is also locked therein, which prevents any rocking movements.

A prerequisite for the most advantageous use of the leg for a piece of furniture according to the invention is that the piece of furniture is levelled relative to the floor, before the height-adjustment takes place. By doing so, it becomes possible to change the height-adjustment without losing the levelling. It is therefore preferred according to the invention to provide the base of the leg for the piece of furniture with an externally threaded tap, by means of which the base is connected with the lower leg portion, said threaded tap being longer than the distance between the steps of the locking mechanism.

Other advantageous embodiments appear from the remaining, dependent claims and from the following detailed description.

Figure 2B:
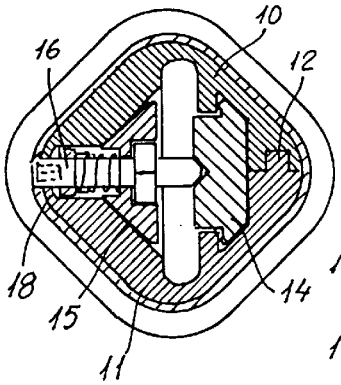
Figure 2A:
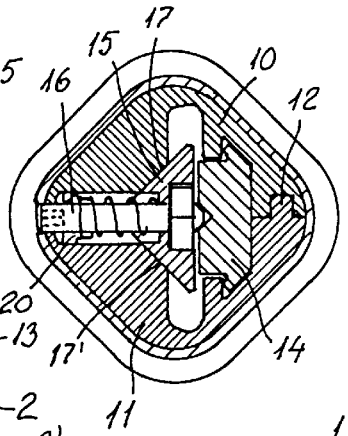
Figure 3:
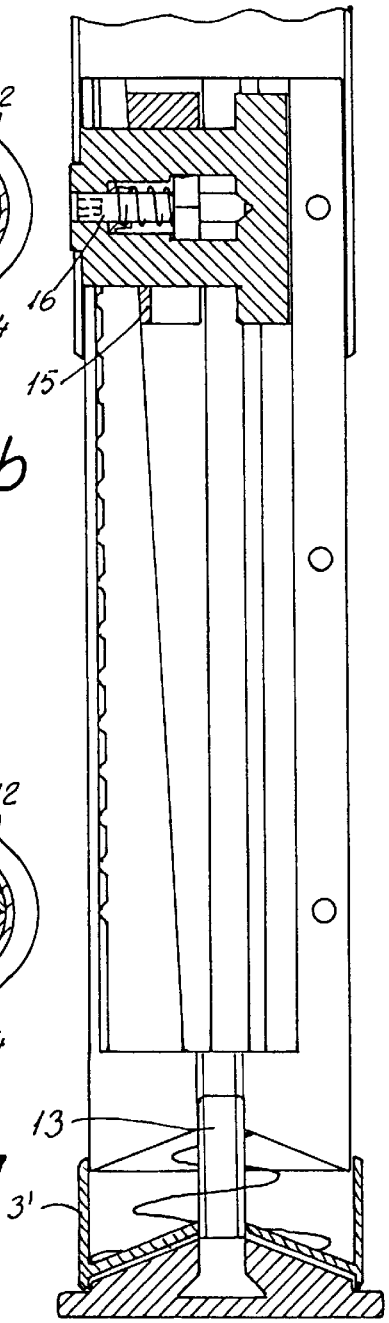
Figure 4:
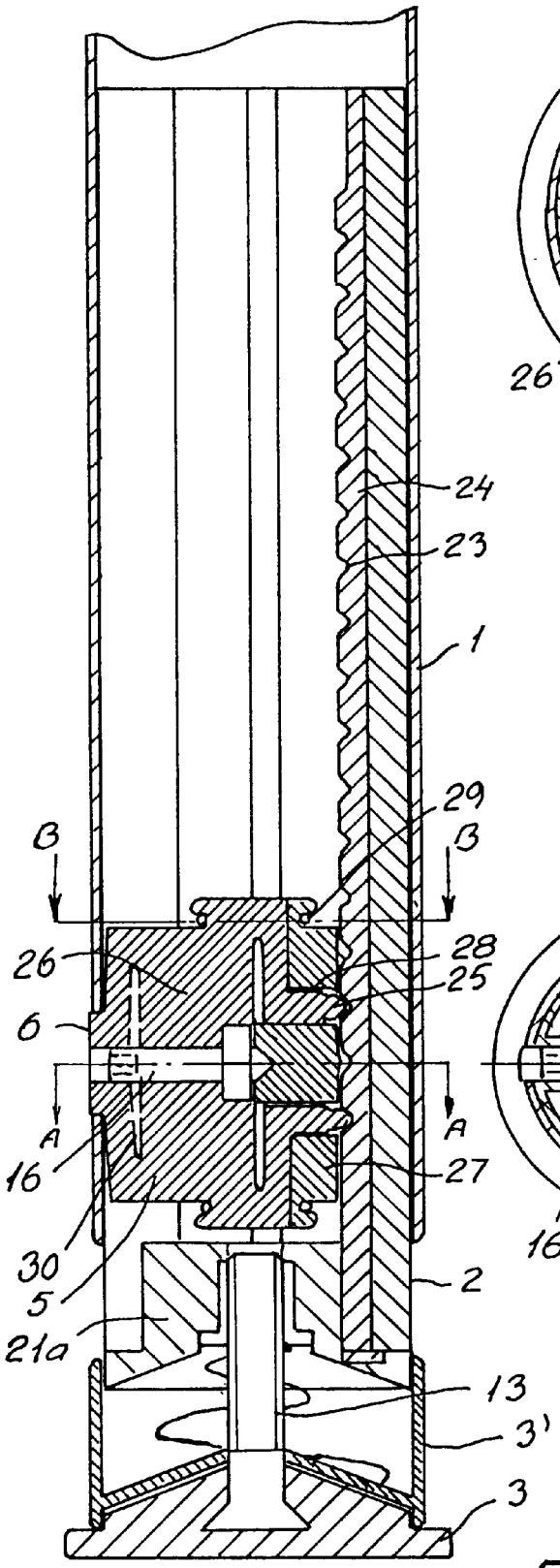
Figure 5B:
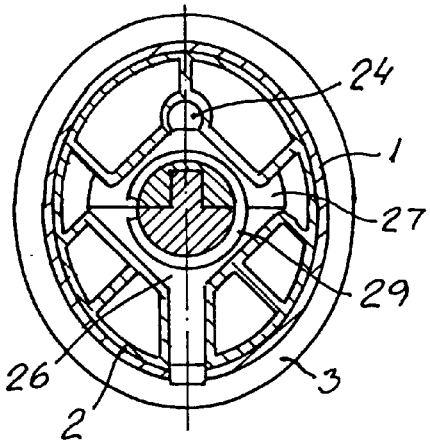
Figure 5A:
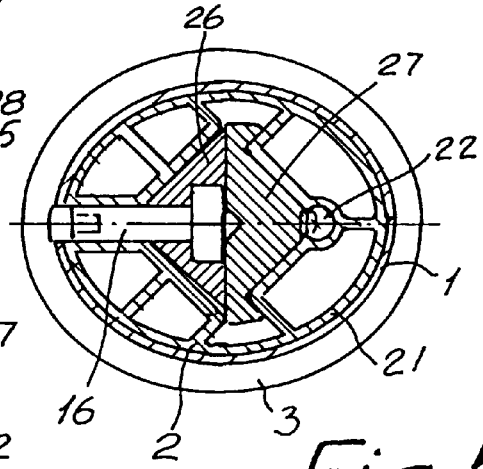
Figure 6:
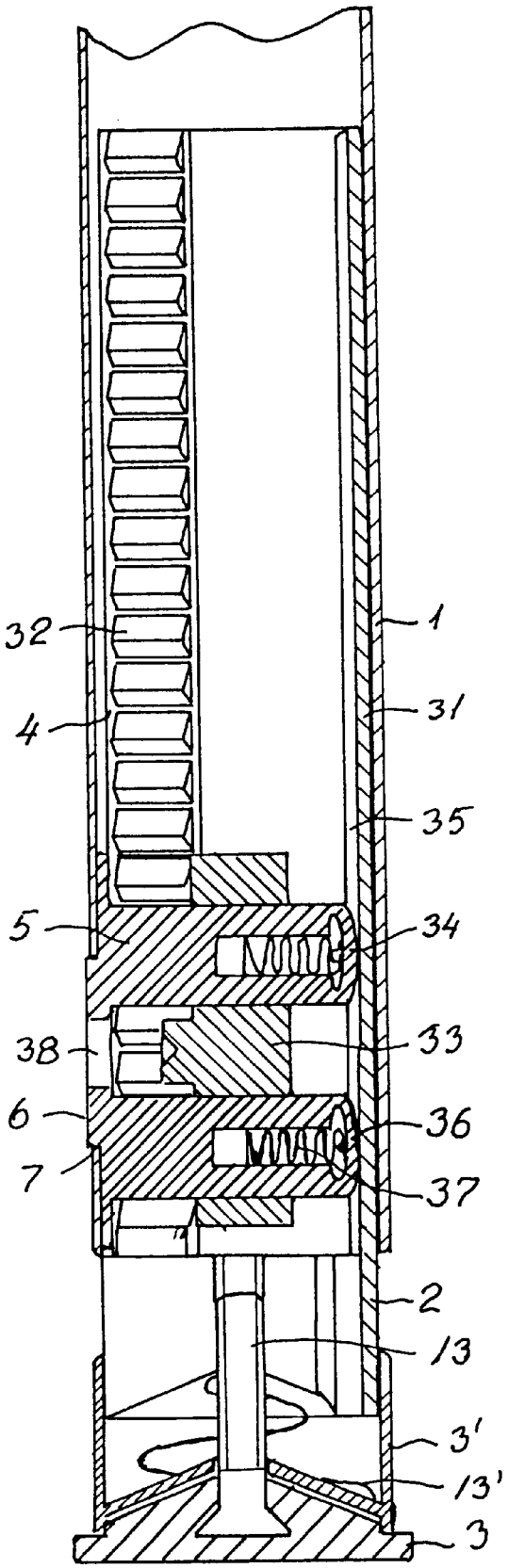
Figure 7:
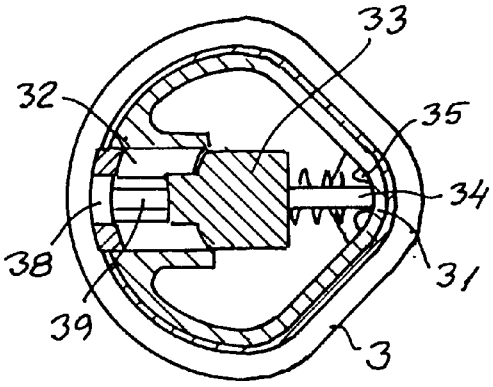
Figure 9:
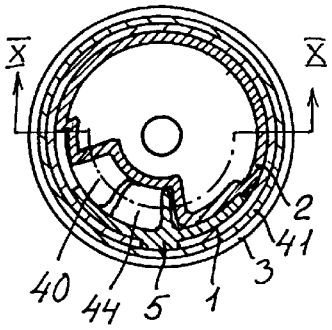
Figure 8:
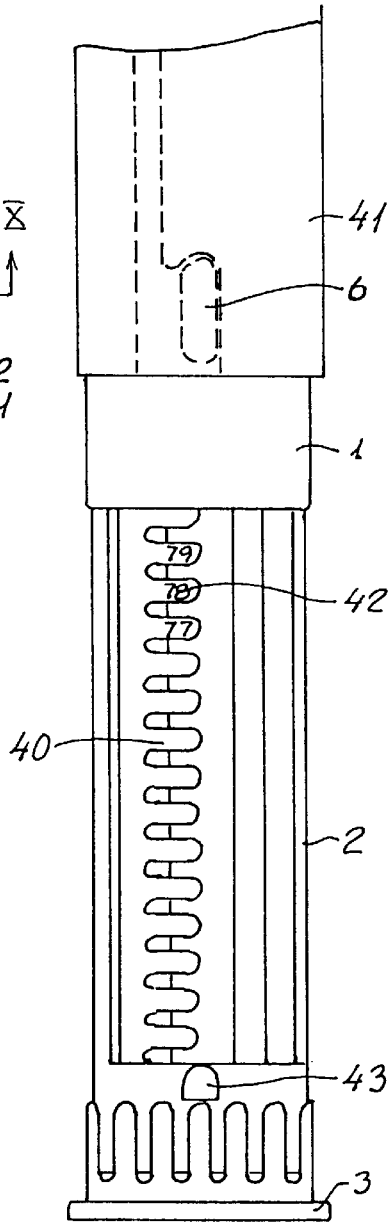

The invention will now be described in detail in the following with reference to the drawing, in which:

FIG. 1 is a longitudinal view through a part of a leg for a piece of furniture according to the invention in a first embodiment in telescoped condition, FIGS. 2*a* and 2*b* show cross-sectional views through the leg for the piece of furniture opposite the fixing means, the lower portion being shown pulled out in different positions, FIG. 3 shows the leg for the piece of furniture according to FIG. 1 in fully pulled out condition, FIG. 4 is a longitudinal sectional view through a part of a leg for a piece of furniture in a second embodiment according to the invention in telescoped condition, FIGS. 5*a* and 5*b* show cross-sectional views through the leg for the piece of furniture according to claim 4, FIG. 6 show a longitudinal sectional view through a third embodiment of a leg for a piece of furniture according to the invention in telescoped condition, FIG. 7 is a cross-sectional view through the leg for the piece of furniture according FIG. 8 shows a leg for a piece of furniture according to the invention in a fourth embodiment in partially pulled out condition, FIG. 9 is a cross-sectional view through the leg for the piece of furniture according to FIG. 8 through the fixing means.

Figure 10:
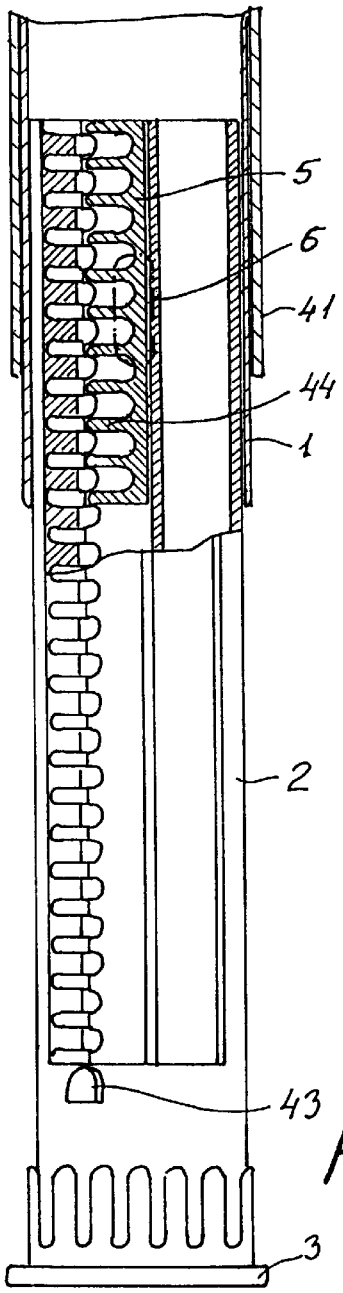
Figure 11:
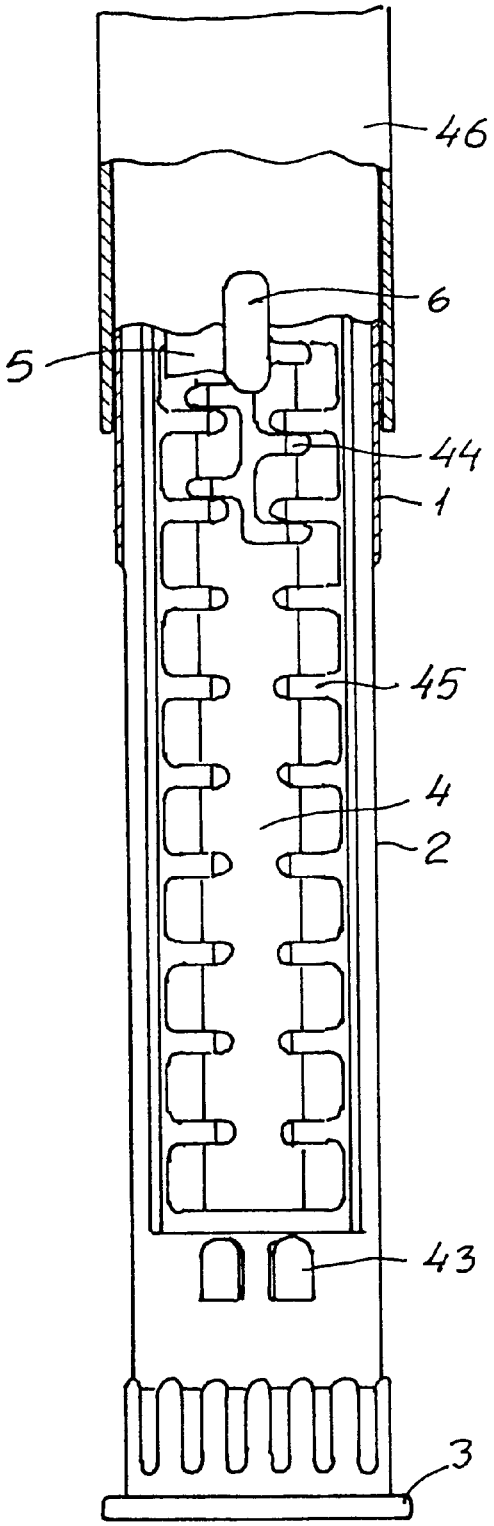

FIG. 10 shows another view of the leg for the piece of furniture according to FIG. 8 with a segment which is a projection of a section along the line X—X according to FIG. 9, and FIG. 11 is a partial sectional view of a variant of the embodiment according to FIG. 8.

In the drawing the same reference numerals are used for the parts which are common to the various embodiments shown in the individual figures.

The sectional view of the leg for the piece of furniture shown in FIG. 1 comprises an upper portion 1 in the shape of a tube with a constant cross-section. In the embodiment according to FIG. 1, the cross-sectional shape may, deviate from a circle and may for instance, be approximately quadrangular with rounded corner edges or, for instance, oval. In the tube, a lower portion 2 is movably arranged with a cross-section having an outer contour approximately corresponding to the contour of the clear in the upper portion 1. The lower portion 2 is provided with a base 3, by means of which it is resting against the floor. The lower portion 2 is provided with a groove, in which a fixing means 5 has been arranged, and by means of which the lower portion 2 may be fastened in the upper leg portion. In the embodiment according to FIG. 1, the groove is deep and undercut, such that in the undercut portion room is provided for the fixing means 5 which is designed as a two-part expansion device. When the fixing means is expanded the slit up, lower leg portion is expanded too in the area which is placed in the lower portion of the upper leg portion 1, the two portions being fixedly and immovably connected. The fixing means is retained in the upper leg portion 1 by means of a protrusion 6 filling in a hole 7 in the wall of the tube constituting the upper leg portion 1. Between the fixing means 5 and the lower leg portion 2, a locking mechanism is provided which in the present embodiment is a click mechanism causing a stepwise movement of the lower leg portion 2 relative to the fixing means 5. One of the concepts on which the invention is based is that it should be possible, in a simple way, to change the height of a piece of furniture provided with legs according to the invention without having to adjust a levelling previously performed.

As will be seen from FIGS. 2*a* and 2*b* the lower leg portion 2 is manufactured from two parts 10, 11, which are assembled by means of taps 12 constituting a part of the one part, and which engage holes in the other part. The two parts which may, for instance, be injection moulded plastic members are moreover assembled by gluing or in any other suitable way at the ends of the parts 10, 11 to keep these fixedly connected. Half of a thread is provided in the two parts 10, 11, in which a screw 13 on the base 3 has been inserted. The base is further provided with a sleeve 3' hiding the slot which is created when the base is unscrewed relative to the lower portion in connection with a levelling of the piece of furniture. Between the two parts 10, 11, a groove is formed which opposite the connection between the two parts 10, 11 has the shape of a slot, through which the fixing means 5 is protruding and by the protrusion 6 is kept in the hole 7. The fixing means 5 consists in this embodiment of two parts 14, 15, which by means of a pointed screw 16 may be unscrewed and thus expanding the lower leg portion which is then fixedly locked in the tube constituting the upper leg portion 1. The parts 10, 11 comprise two oblique surfaces 17,17', which, when the piece of furniture is lowered and the legs loaded, may be gradually lowered by loosening of the pointed screw 16. Along the two sides of the slot, list-shaped protrusions 18 with recesses 19 are provided, in which a spring-loaded click-member 20 with protrusions corresponding to the recesses is in engagement.

In unloaded condition, the leg for the piece of furniture may according to the first embodiments be adjusted by loosening the pointed screw, which is provided with an interior hexagon, and adjustment of the lower part which is stepwise movable on account of the click-member to the desired height and renewed screwing of the pointed screw 16. FIG. 3 is a sectional view through a part of the leg of furniture according to FIG. 1 in completely telescoped condition. The interior hexagon in the pointed screw may advantageously be identical with the one which is generally used for assembling the piece of furniture.

FIG. 4 is a sectional view through a part of another embodiment for a leg for a piece of furniture according to the invention. In this embodiment, the lower portion 2 has the shape of a profile member 21 extruded from aluminium or plastics. For fastening of the base 3, a packing piece 21*a* of plastics with a threaded hole for receiving the tap screw 13 of the base is inserted. This embodiment is similar to the embodiment according to FIG. 1 in that it is also suitable for the upper leg portions having a cross-section deviating from circular. In the example shown, the upper leg portion is oval. Like the embodiment according to FIG. 1, the base is provided with a sleeve 3', which on account of its out of round cross-section is to be lifted to allow the base to be rotated. The sleeve 3' thereby constitutes a securing against rotation for the base 3. In an undercut groove 22 in the lower leg portion, a plastic list 24 provided with recesses 23 is inserted, said list constituting one part of the locking mechanism. The second part is constituted by a pair of taps 25 on one part 26 of the fixing means 5. The second part 27 comprises a pair of holes 28, in which the taps 25 are guided. The part 26 comprises the protrusion 6 which is retained in the hole 7 in the tube wall of the upper leg portion 1. Between the parts 26, 27, a pointed screw 16 is inserted through a nut embedded in the part 26 and adapted to unclamp the two parts with a view to wedging the fixing member in the lower part. The two parts are in consideration of the mounting and for release of the wedging held together by spring rings 29. It is a prerequisite for the working of the arrangement that there is a possibility of a certain flexibility. This flexibility may be obtained in many ways. The plastic list 24 may be hollow or U-shaped to be flexible enough to allow the taps 25 to pass through the recesses 23. Alternatively, the taps 25 may be flexibly mounted on the part 26, whereby the taps may be sufficiently flexible for causing the click effect. A second alternative is that the protrusion 6 is designed resiliently relative to the part 26 as such. In FIG. 4, a recess 30 is shown in dotted lines, said recess making such a flexibility possible.

A third embodiment is shown in FIG. 6. This embodiment is like the above ones also suited for legs for a piece of furniture having a non-circular cross-section. The lower leg portion 2 has, as will be best seen from FIG. 7 which is a cross-sectional view, a flexible portion 31, whereby it become possible during the casting to completely or partially unfold the lower part in order to simplify the casting mould. When the lower part 3 is mounted in the upper part, it is clamped, whereby the groove 4, in which the fixing means is mounted, is created and achieves its correct width. The side walls of the groove are provided with a toothing 32, in which a toothed wedge 33 may get into engagement. The toothed wedge 33 is embedded and guided along a pair of guides 34 on the fixing means 5, said guides extending perpendicularly to the longitudinal axis of the lower portion. These guides rest against the flexible portion between a pair of longitudinal guide lists 35. The guides 34 are preferably at the ends provided with a pair of resilient protrusions 36 which imparts sufficient flexibility to the fixing means to allow it to be inserted in the upper portion 1 of the leg for the piece of furniture and with the protrusion 6 to spring into place in the hole 7 in the tube wall. The guides also form the seat for a pair of screw springs 37 which presses the toothed wedge 33 into engagement with the toothing 32. The toothed wedge 33 may be controlled through an opening 38 in the protrusion 6. It is also possible to give the toothed wedge such a shape that when pulled outwards in the slot, it unclamps the two toothings 32, whereby the lower portion is retained immovably in the upper portion. The outward pull in the toothed wedge 33 may be created by means of a screw 39 inserted through the protrusion 6, said screw being also used as a control means for pressing in the toothed wedge 33, which then disengages the toothing 32 when the leg for the piece of furniture is to be height-adjusted. Besides, the toothing is designed such that the weight of the leg causes the two toothings to be untightened by means of the toothed wedge 33. The loaded leg will consequently become very rigid and stable.

In the embodiments described above, it is advantageous to provide between the sleeve 3' on the base 3 and the lower leg portion 2 a comparatively soft spring 13' which secures against unintentional lifting of the sleeve and thus release of the securing against rotation of the base.

FIG. 8 shows a fourth embodiment of the leg for the piece of furniture according to the invention, in which the release of the fixing means is performed by rotating the lower portion 2 relative to the upper portion 1. It is in this embodiment a prerequisite that the leg for the piece of furniture has a circular cross-section. As will appear from FIG. 8, the longitudinal groove is provided with a toothing 40 along one of its sides. The fixing means 5 is equipped with a kind of cam, which may be brought into disengagement and engagement, respectively, with the toothing 40 by rotation of the lower portion of the leg for the piece of furniture. A drawback of the arrangement is that the adjustment cannot be performed straight away while the leg for the piece of furniture is loaded, but otherwise the functioning is reliable and easy to understand. It is preferred to provide the leg for the piece of furniture with a covering skirt 41, which by means of an interior profiling, which for instance co-operates with the protrusion 6, is fastened and secured against rotation relative to the upper portion 1. When the leg for the piece of furniture is to be height-adjusted, the covering skirt 41 is lifted, whereby the groove with the toothing becomes exposed. The toothing may be provided with an index 42, from which it may straight away be read, how high the piece of furniture will become with the present adjustment. When the adjustment has been made, the covering skirt is lowered and brought into engagement with a locking protrusion 43 on the lower portion 2. Following this, the upper and the lower portions of the leg for the piece of furniture are locked and secured against rotation and the adjusted height retained. The fixing means is preferably provided with a spring pressing the lower leg portion 2 in the direction of the locked position. An index corresponding to the index 42 may besides also used in the other embodiments with a view to facilitating the adjustment and securing that the legs have the same height-adjustment.

FIG. 9 shows a cross-section through the leg for the piece of furniture according to FIG. 8. In the figure, the fixing means 5 is shown out of engagement with the toothing 40. The fixing means transfers the load on the upper portion to the lower portion through the protrusion 6, which is inserted in the hole 7 in the tube wall of the upper portion, and transfers the forces to the toothing 41 in the groove by means of the cam-like portion 44, which is in particular depicted in FIG. 10, which is a sectional projection view of a section along the line X—X according to FIG. 9. As will appear from FIG. 8, the lower portion is provided with a base 3 fastened by means of a threaded tap. The base 3 is not, as is the case of the embodiments described above, provided with a liftable sleeve, but with an upright collar adapted to co-operate with the covering skirt 41, thus securing the base against unintentional rotation.

The design of the leg for the piece of furniture as shown in FIGS. 8–10 is like the other embodiments well suited for manufacturing the upper leg portions from seam-welded tubes. The hole, in which the protrusion 6 is to rest, is placed in the welding seam, whereby the parts, which are to be secured against rotation relative to the upper portion, are not influenced thereby, provided that a suitable nut is provided, in which the welding seam may be held. This does not apply to the lower portion which may be rotated freely against the smooth wall of the tube. These embodiments also excel in that no tool is needed for making a height-adjustment.

A variant of the embodiment according to FIG. 8 is shown in FIG. 11. The groove 4 is in this embodiment provided with a toothing 45 along both sides. The fixing means 5 is correspondingly provided with cam-like protrusions at both sides. When the lower leg portion 2 is rotated to one side, the cam-like protrusions disengage the toothing in the other side of the groove 4, whereby the cam-like protrusions only engage one of the toothings. The toothings are, however, provided with small teeth and so big spacing among the teeth that the fixing means is just able to move over such a distance that the opposite cam-like protrusions by rotating back the lower leg portion may engage, either above or below a pair of protrusions on the other side of the groove 4. It is therefore possible, by alternatingly rotating the lower leg portion to one side or the other, to stepwise raise or lower the piece of furniture. The principle is indicated in FIG. 11, which shows a leg for a piece of furniture with a part of the upper leg portion and a part of the fixing means 5 cut away. Also in this embodiment it is advantageous to provide the leg for the piece of furniture with a covering skirt 46, which may also serve as a securing against rotation, partly for the stepwise height-adjustment, partly for the adjustment of the base.

The embodiments shown in FIGS. 8–11 make use of a covering skirt 41 or 46 as a securing against rotation, which is established when the skirt after the finishing of the adjustment is lowered again. It is, however, often considered aesthetically less advantageous that a leg for a piece of furniture is thicker at its lower portion than at its upper portion, and for this reason it may be desirable to leave out the covering skirt. In the two embodiments the covering skirt may be replaced by a covering screen inserted in a recess surrounding the longitudinal groove 4. In the embodiment according to FIGS. 8–10 the screen may have a slit, the width of which over the major part of the length of the slit exactly corresponds to the width of the protrusion 6, but which over a short stretch is so much wider, that the lower portion of the leg may be rotated for adjustment of the height of the leg, provided the screen is lifted so much that the wider stretch is placed opposite the protrusion 6. The screen then serves both as a locking securing the two leg portions against mutual rotation, when the screen is lowered, and as cover for the longitudinal groove. In the embodiment according to FIG. 11, the screen may be provided with a slit so wide that the necessary rotation of the lower leg portion is possible. The slit should, however, not be extending all the way to the upper edge of the screen, which is provided with a pair of recesses having a depth corresponding to the thickness of the welding seam. These recesses will, however, act like a kind of click-locking counteracting unintentional rotation of the lower portion of the leg for the piece of furniture.

The principle of use for the leg for a piece of furniture according to the invention may be that the piece of furniture at a given positioning is at first levelled by means of the adjustable base/bases, whereby it is firstly secured that the piece of furniture will not rock if the floor is uneven, and secondly, that the piece of furniture is standing horizontally, to prevent for instance drawers, if any, from sliding out by themselves. Then the height of the piece of furniture is adjusted through the adjustment of the legs, all legs being moved the same number of clicks or steps. It is advantageous that these steps are for instance 1 cm, and that the lower leg portions are provided with indexes correspondingly indicating the height of the piece of furniture in cm.

What is claimed is:

1. A leg for a piece of furniture with a telescopically movable portion for adjusting the height of the piece of furniture and comprising an upper leg portion comprising a tube, a lower leg portion provided with a base adapted to rest on a floor, said lower leg portion being inserted into and being telescopically movable relative to the upper leg portion and having a cross-section substantially corresponding to a clear in the upper leg portion apart from a groove extending in a longitudinal direction, and fixing means engaging a hole in the tube wall in the upper leg portion and cooperating with the lower leg portion in the groove, said fixing means functioning to secure the lower leg portion at a predetermined level relative to the upper leg portion, the improvement wherein the groove in the lower leg portion is undercut, in which undercut portion the fixing means are slidably arranged, the fixing means being a locking mechanism which is movable step-by-step in the hollow space defined by the groove and an interior wall of the upper leg portion, and comprising a two-part expansion device with an expansion screw which functions to force the two parts apart to operationally solely engage the groove, the fixing means comprising a protrusion which extends through the hole through which the protrusion is introduced and fixated relative thereto from the inside of an upper wall portion and which protrusion has a bore through which the screw provided with an internal hexagon is accessible.

2. The leg for the piece of furniture according to claim 1, wherein the locking mechanism comprises a resilient click-member in engagement with a list-shaped member with recesses, said list-shaped member is parallel with an axis of the leg portions.

3. The leg for the piece of furniture according to claim 1, wherein the lower leg portion comprises two parts which are assembled by means of taps, the parts being manufactured from injection molded plastic.

4. The leg for the piece of furniture according to claim 1, wherein the lower leg portion is a profile member extruded from aluminum or plastics.

* * * * *

UNITED STATES PATENT AND TRADEMARK OFFICE

CERTIFICATE OF CORRECTION

PATENT NO. : 6,092,771

DATED : July 25, 2000

INVENTOR(S) : Preben Bo Fich

It is certified that error appears in the above-indentified patent and that said Letters Patent is hereby corrected as shown below:

In the title, the word "OF" was omitted.

Please change the title "LEG FOR A PIECE FURNITURE WITH A TELESCOPICALLY MOVABLE PORTION" to read --LEG FOR A PIECE OF FURNITURE WITH A TELESCOPICALLY MOVABLE PORTION--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*